United States Patent [19]

Kobayashi

[11] Patent Number: 4,760,810

[45] Date of Patent: Aug. 2, 1988

[54] HULL FOR SMALL WATERCRAFT

[75] Inventor: Noboru Kobayashi, Kosai, Japan

[73] Assignee: Yamaha Hatsudoki Kabushiki Kaisha, Iwata, Japan

[21] Appl. No.: 933,626

[22] Filed: Nov. 21, 1986

[30] Foreign Application Priority Data

Nov. 21, 1985 [JP] Japan ..... 60-261838

[51] Int. Cl.[4] ..... B63B 1/20

[52] U.S. Cl. ..... 114/56; 114/290; 114/62

[58] Field of Search ..... 114/56, 62, 270, 288, 114/290; 440/42, 38; D12/307, 310–314

[56] References Cited

U.S. PATENT DOCUMENTS

| | | | |
|---|---|---|---|
| Re. 30,978 | 6/1982 | Jacobson | 440/42 |
| D. 241,328 | 9/1976 | Naito | D12/307 |
| D. 285,678 | 9/1986 | Suzuki et al. | D12/307 |
| 3,216,389 | 11/1965 | Thorsen | 114/56 |
| 3,930,455 | 1/1976 | Bremer | 114/290 |

*Primary Examiner*—Sherman D. Basinger
*Assistant Examiner*—Edwin L. Swinehart
*Attorney, Agent, or Firm*—Ernest A. Beutler

[57] ABSTRACT

A hull configuration for a watercraft that improves stability in straight ahead running without significantly increasing the resistance to forward movement. The hull is comprised of a generally flat center section that is surrounded on each longitudinal side by a pair of arcuate sections, the outer peripheries of which are defined by respective chines.

6 Claims, 7 Drawing Sheets

Fig-5
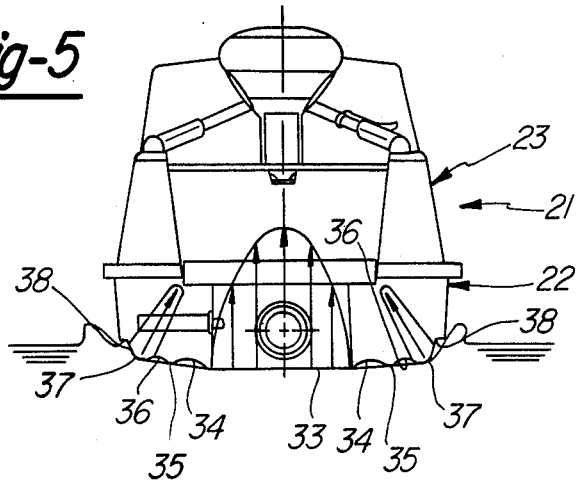
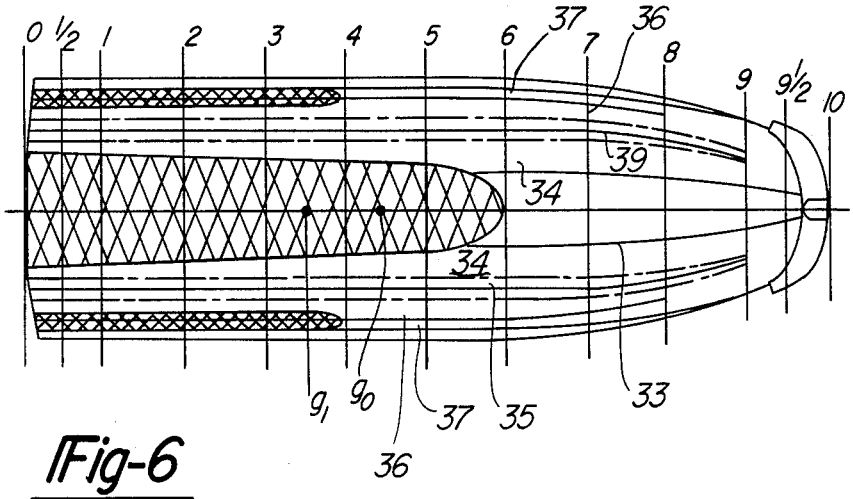
Fig-6
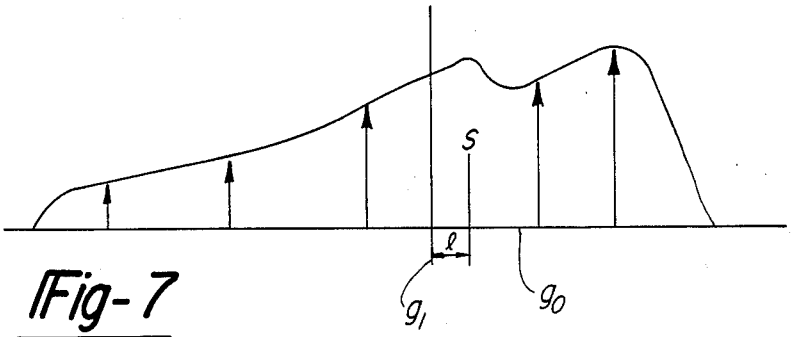
Fig-7

Fig-8
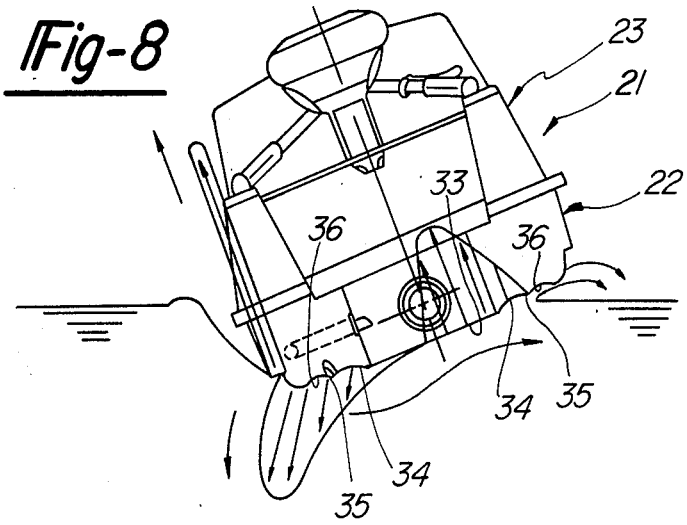
Fig-9
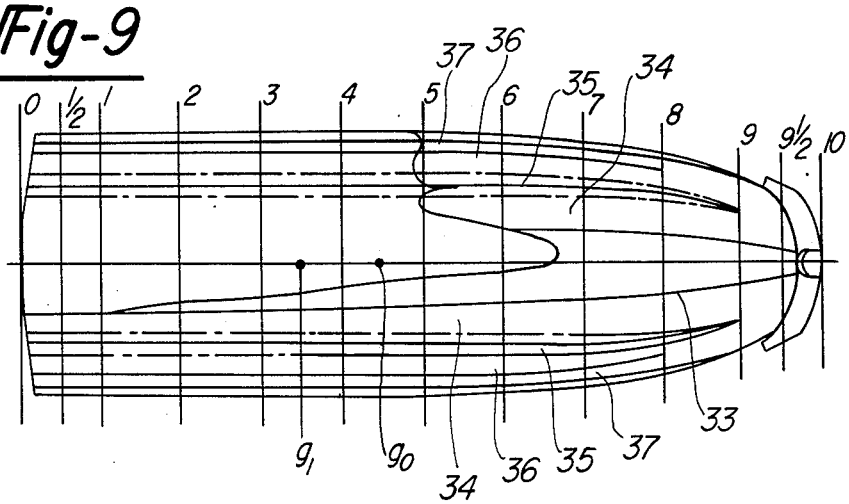
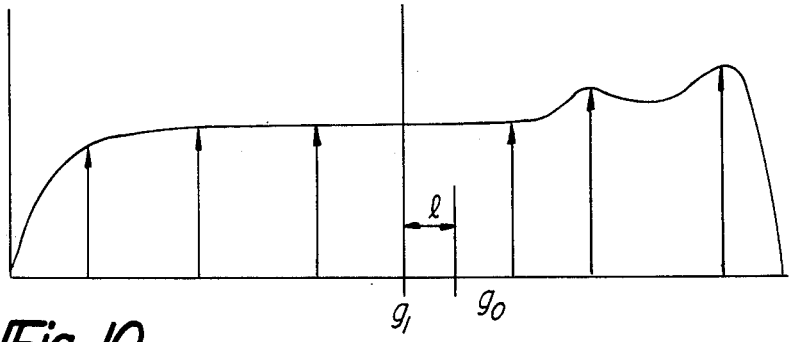
Fig-10

HULL FOR SMALL WATERCRAFT

BACKGROUND OF THE INVENTION

This invention relates to an improved hull design for small watercraft and more particularly to a hull design that improves stability, reduces resistance and which affords better handling.

The hull of a watercraft must serve a plurality of generally inconsistent functions in connection with its dynamic characteristics. That is, the hull should be capable of providing very low resistance to forward travel so as to improve the performance of the vehicle in a straight line without necessitating large powering engines. However, at the same time, the hull design should provide good stability of the watercraft when traveling in a straight line.

Somewhat inconsistent with the straight line performance requirements, the hull should also be capable of permitting the watercraft to be maneuvered sharply and without a large degree of side to side rolling. Furthermore, it is desirable to permit some side to side rolling of the watercraft in order to improve its buoyancy and turning ability, however, the watercraft should be stable and not capable of being easily capsized when making sharp maneuvers.

A particularly popular type of small watercraft is of the type that is designed to handle primarily a single rider and which the rider operates in a swimming suit or wetsuit due to the sporting nature of the watercraft. The very compact nature and small size of this type of watercraft aggravates the problems in hull design as already described.

It is, therefore, a principal object of this invention to provide an improved hull design for a watercraft that will increase stability and handling. It is a further object of the invention to provide a hull design that will offer low resistance when running in a straight ahead direction but also which will have high stability in this mode of operation.

It is a further object of this invention to provide a hull design that permits abrupt maneuvering and good handling without adversely affecting the running in a straight ahead direction.

SUMMARY OF THE INVENTION

A first feature of this invention is adapted to be embodied in a watercraft hull for increasing stability and handling and comprises a generally flat undersurface that extends for a portion of the width on both sides of the longitudinal center line of the hull. A pair of curved sections are each formed on respective transverse outward sides of the flat undersurface for generating a reduced pressure area on opposite sides of the flat underside area for reducing frictional loses and increasing stability.

Another feature of the invention is also adapted to be embodied in a watercraft hull for increasing stability and handling and comprises a generally flat undersurface that extends for a portion of the width of the watercraft on both sides of its longitudinal center line. A pair of generally upwardly sloping surfaces are formed on opposite sides of the flat undersurface and each terminate in generally horizontally extending undersurfaces that are adapted to engage the water upon leaning of the watercraft for adding to its stability and for limiting the amount of leaning permitted.

BRIEF DESCRIPTION OF THE DRAWINGS

FIG. 5 is a rear elevational view, in part similar to FIG. 3, and shows the cooperation of the hull and water when traveling under a planing, high speed condition.

FIG. 6 is a bottom plan view showing the water contact area with the hull under the conditions shown in FIG. 5.

FIG. 7 is a graphical view showing the buoyancy forces exerted on the underside of the watercraft in a front to rear direction under the conditions shown in FIGS. 5 and 6.

FIG. 8 is a rear elevational view, in part similar to FIGS. 3 and 5, showing the configuration and water pressures acting when making a turn.

FIG. 9 is a view, in part similar to FIG. 6 showing the water pressure acting on the underside of the watercraft when in the condition shown in FIG. 8.

FIG. 10 is a graphical view showing the front to rear water pressure existent on the watercraft during the conditions shown in FIGS. 8 and 9.

DETAILED DESCRIPTION OF THE PREFERRED EMBODIMENT

Figure 1:
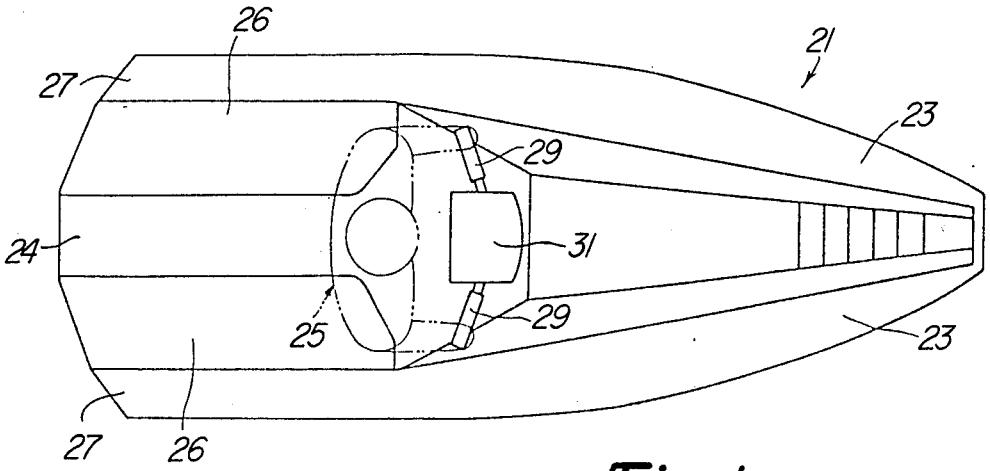
FIG. 1 is a top plan view of a small watercraft constructed in accordance with an embodiment of the invention.
Figure 2:
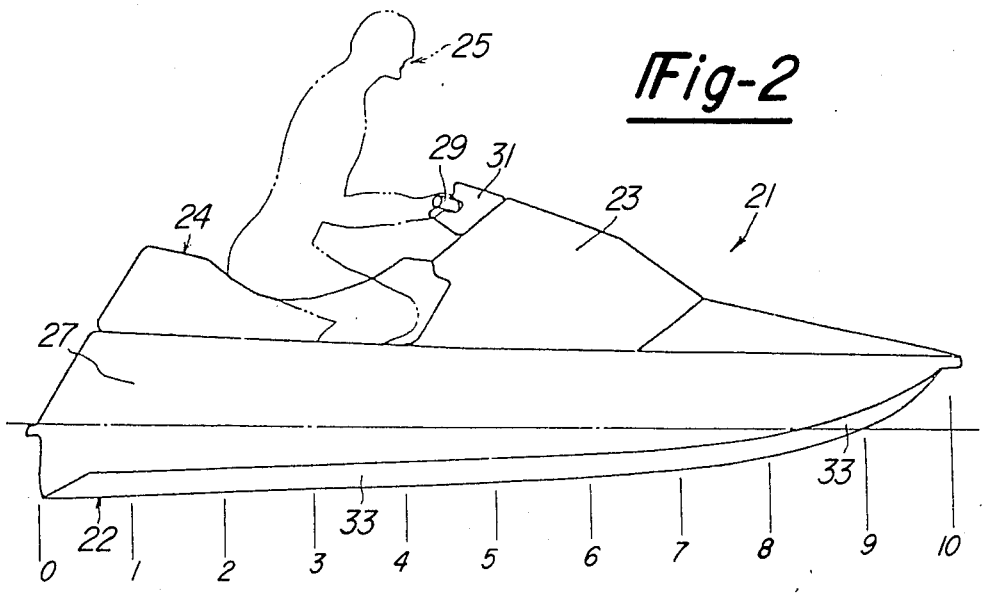
FIG. 2 is a side elevational view of the watercraft.
Figure 3:
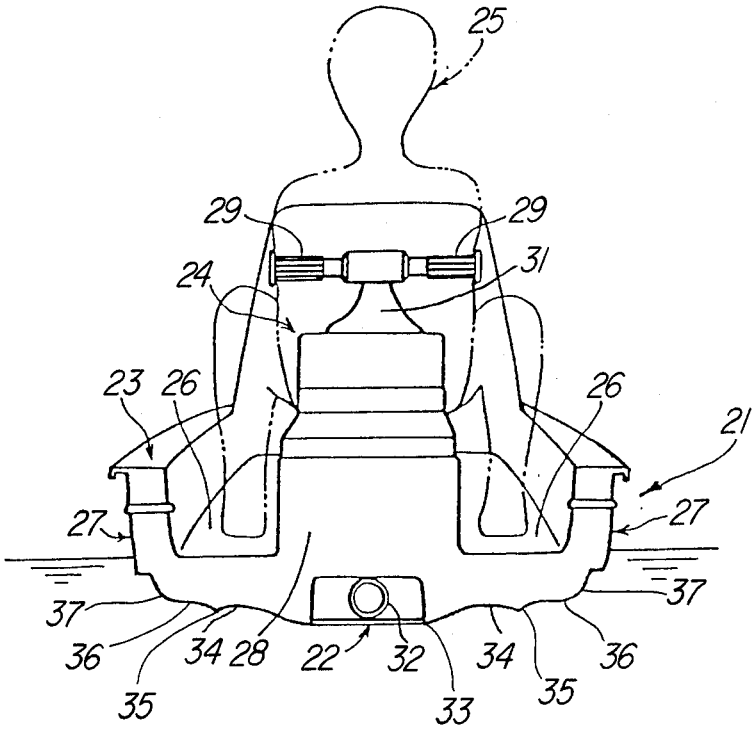
FIG. 3 is an enlarged rear elevational view of the watercraft.
Figure 4:
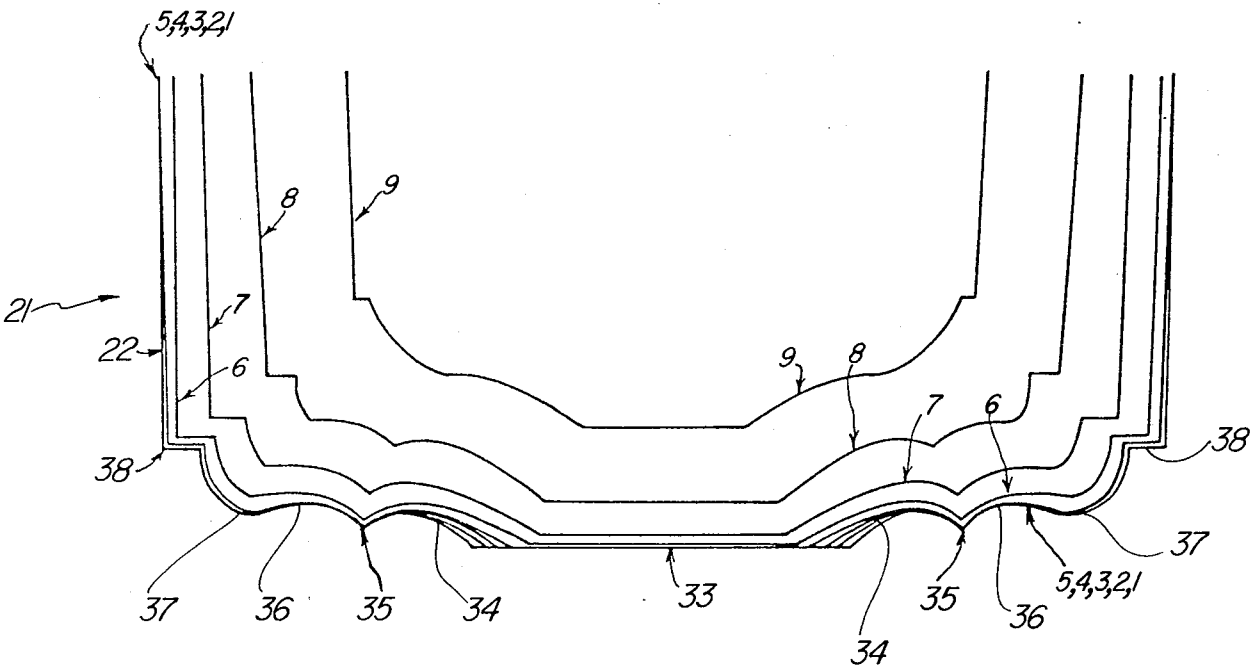
FIG. 4 is a family of cross-sectional views taken along the line 1 through 9 of FIG. 2 and show the cross-sectional configuration of the hull.
Figure 4A:
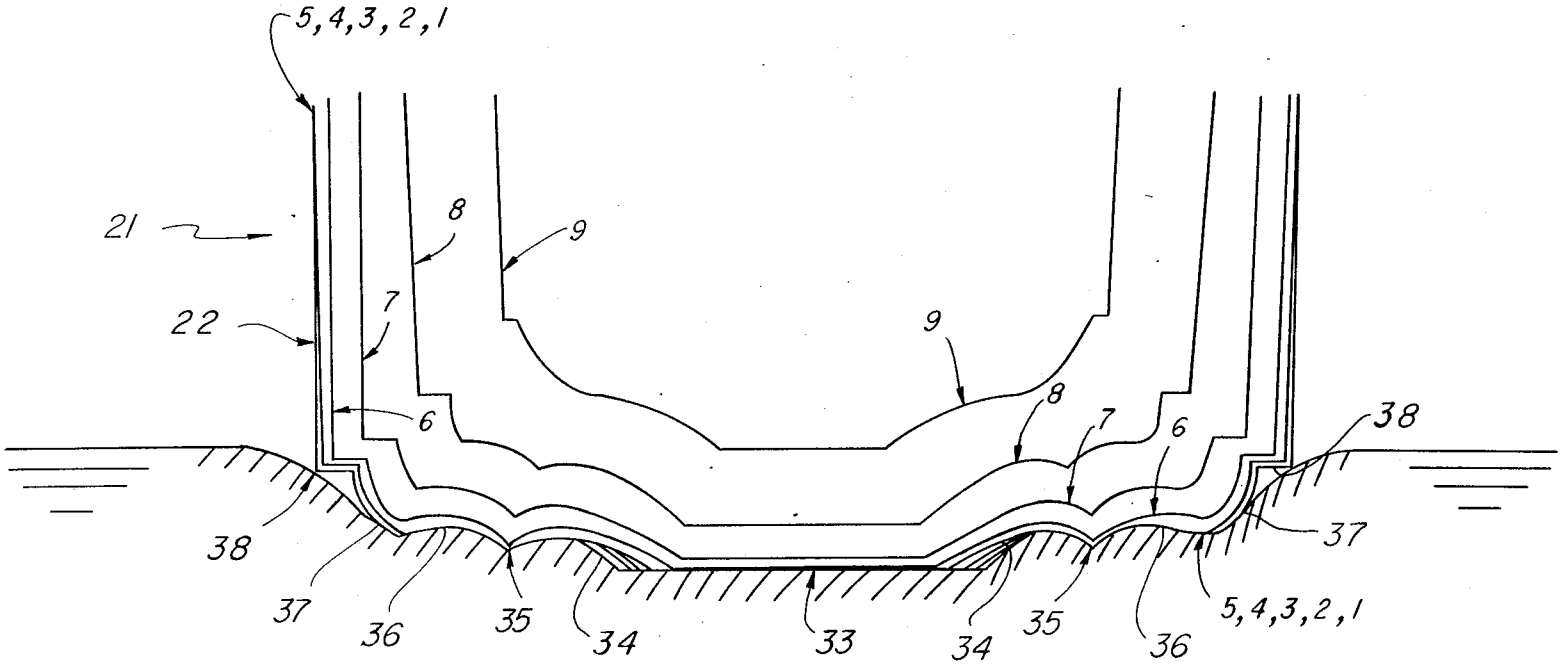
Figure 4B:
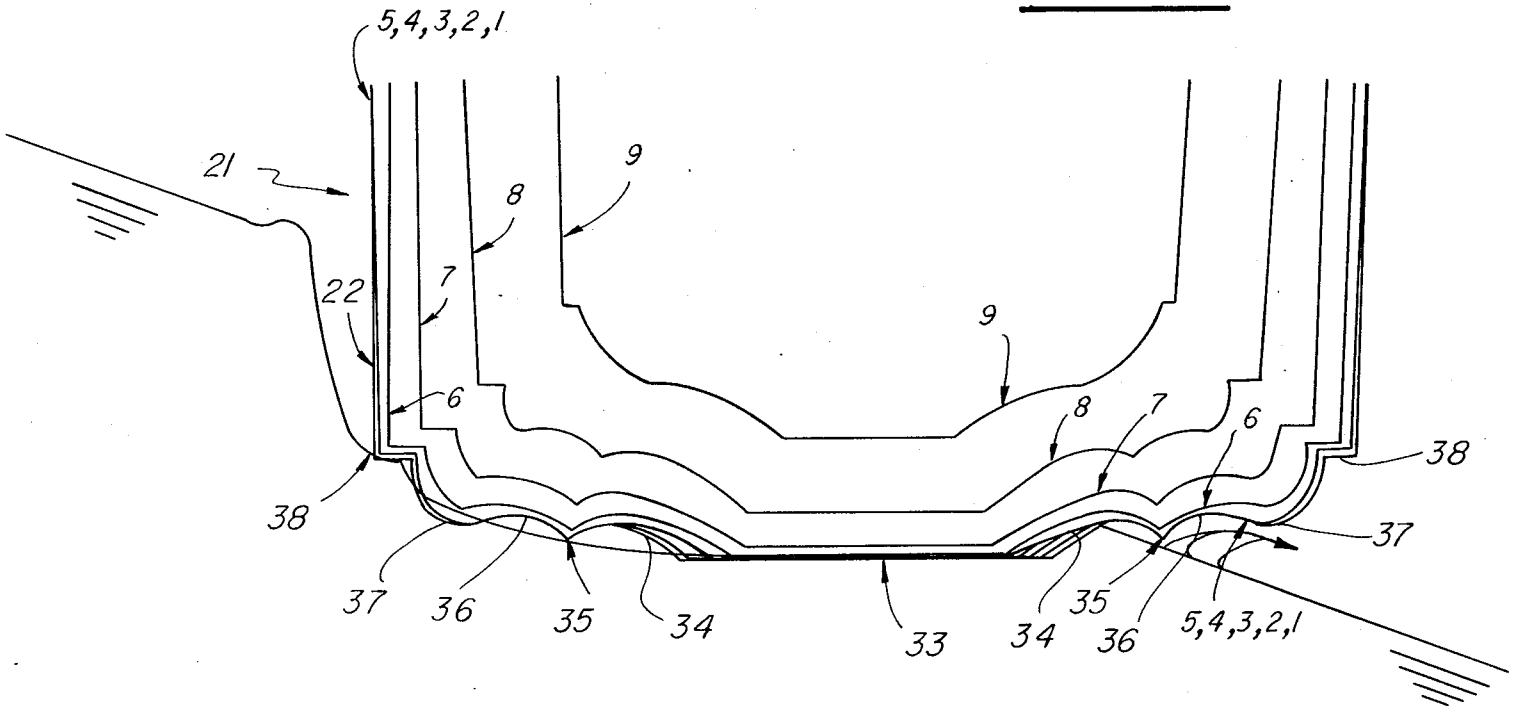

Referring first primarily to FIGS. 1 through 4, a small watercraft constructed in accordance with an embodiment of the invention is identified generally by the reference numeral 21. The small watercraft 21 is comprised of a hull 22 and a deck 23. The hull 22 and deck 23 are affixed to each other in a suitable manner and are formed from a suitable material such as a fiber glass reinforced plastic.

The deck 23 forms a raised seat 24 at the rearward portion of the hull 21 which seat is designed so as to accommodate primarily a single rider, shown in phantom in some of the views and identified generally by the reference numeral 25. The seat 24 is disposed at the rearward end of the watercraft 21 and is bounded by a pair of foot well portions 26 that are defined on opposite sides of the seat at their longitudinal inner portions and by a pair of raised gunnels 27 at their outer portion. It should be noted from FIG. 3 that the foot well portions 26 extend rearwardly and open through a transom 28 formed at the rear of the watercraft. This arrangement permits water to enter the foot wells 26 in the event the vehicle becomes capsized so as to facilitate ease of reentry.

A steering handlebar assembly 29 is supported by a steering support mechanism 31 that is carried by the deck 23 in a suitable manner. The handlebar mechanism 29 is disposed substantially in line with the fore and aft center of gravity $G_o$ (FIGS. 6 and 9) of the watercraft 21.

The watercraft 21 is powered by means of a jet drive unit (not shown) that is disposed in the longitudinal center plane of the watercraft 21 in an area positioned beneath and to the rear of the seat 24. This jet drive unit is driven by an internal combustion engine (not shown) in any known manner, which engine is disposed forwardly of the seat 24 and in general alignment with the steering handle 29 so as to locate the center of gravity of the watercraft, as will be described. The water is discharged from the impeller unit of the jet drive unit back to the body of water in which the watercraft 21 is operating through a pivotally supported discharge nozzle 32. The nozzle 32 is steered, in any suitable manner, by means of the handlebar assembly 29 and this steering mechanism may include flexible cables that interconnect the handlebar 29 with the nozzle 32 in a known manner.

In a general sense, the configuration and layout of the watercraft 21 may be considered to be conventional. However, the important features of the invention have to do with the configuration of the underside of the hull and its relationship to the overall balance of the watercraft 21. It is believed that those skilled in the art are well versed on how to arrange such components and reference may be had to my copending application entitled "Component Layout For Small Watercraft", Ser. No. 935,337, filed Nov. 26, 1986 and assigned to the assignee of this application for a description of how the components may be arranged to achieve the desired location of the center of gravity.

The hull configuration and how it operates to produce the desired results will now be described by primary reference to FIGS. 3 through 10. The undersurface of the hull 22 includes a centrally positioned, relatively shallow longitudinally extending keel 33 that extends from the bow of the boat and which terminates adjacent to the transom 28. As may best be seen in FIGS. 6 and 9, the keel is narrow at the front of the hull 21 and tapers outwardly toward the transom 28. At the rear end of the hull 22, the keel 33 has a width that is about equal to one-third of the total width of the watercraft. It should be noted from FIGS. 6 and 9 that the sides of the rear portion of the keel 33 extends in a generally parallel direction relative to the longitudinal center line of the watercraft.

On opposite sides of the keel 33, the underside of the watercraft is formed with a first pair of arcuate shaped sections 34 that define a concave area in the underside of the hull. These concave portions 34 are designed, as will become apparent, so as to provide a negative pressure or reduced pressure area that will improve stability during straight ahead running. The outer peripheral edges of the concave portions 34 are defined by raised projections 35 which act like chines so as to provide stablity in a forward running mode as will become apparent.

Disposed transversely outwardly of the chines 35, there is provided a second pair of concave areas 36. The second concave areas 36 also terminate in a second pair of generally longitudinally disposed chines 37.

It should be noted from FIGS. 6 and 8 that the chines 35 and 37 extend generally in a longitudinal direction and parallel to the longitudinal center line of the watercraft until a point well forward of the center of gravity $G_0$. Forwardly of this point, the chines 35 and 37 curve inwardly toward the bow of the watercraft.

The hull curves upwardly from the outer periphery of the chines 37 and terminates in generally horizontally extending chines 38 that are positioned a substantial height above the chines 35 and 37.

The configuration of the underside of the hull as thus far described is very effective in providing good stability when running at high speeds in a straight ahead direction while, at the same time, insuring against high fluid resistances. Furthermore, the hull configuration is such that it permits the operator to lean and tilt the boat into a turn while, at the same time, offering good resistance to overturning and stability that will assist in turning.

FIGS. 5 through 7 show the condition when running in a straight ahead direction and at high or planing speeds. It will be noted from FIG. 6 that the water contact area on the bottom of the watercraft is confined primarily to the keel area 33 and the area of the outer pair of chines 37. In addition, the tips of the chimes 35 will just contact the water so as to provide good stability in the straight ahead direction. As may be seen from FIG. 6, the amount of contact area is relatively small and nevertheless there is adequate buoyance. FIG. 7 illustrates the buoyant force curve with respect to the normal center of gravity of the watercraft unloaded ($G_0$) and also that of the watercraft when a rider is in place, this center of gravity being indicated by the point $G_1$. The fact that no water exists in the area of the recesses 36 and 37 causes a reduced pressure area that assists in the holding of the watercraft in a straight ahead position.

If the watercraft operator wishes to execute a turn, he steers the handlebar 29 in the appropriate direction and leans the watercraft into the turn. When making a left turn, this will cause the hull at the left side of the watercraft (in the illustration of FIGS. 8 through 10) to become submerged while the hull at the right hand side will raise. The chines 35 will, however, be maintained submerged as will the entire side of the watercraft to the left of this. As may be seen from FIG. 9, therefore, there is a good buoyant force that will prevent overturning. Also, the horizontally extending surface 38 of the outermost chines will provide very good stability and will reduce the likelihood of overturning when leaning in this manner. However, the fact that the recessed areas 34 and 36 as well as the area 38 are out of the water in normal straight ahead running, assist in the leaning of the watercraft to shift from the position shown in FIGS. 5 through 7 to the position shown in FIGS. 8 through 10.

It should be readily apparent from the foregoing description that the described watercraft configuration provides very good handling, low resistance toward straight ahead running and, furthermore, extremely good maneuverability. Although an embodiment of the invention has been illustrated and described, various changes and modifications may be made without departing from the spirit and scope of the invention, as defined by the appended claims.

I claim:

1. A watercraft hull for increasing stability and handling comprising a generally flat undersurface extending for a portion of the width of said hull on both sides of its longitudinal center line, a first pair of curved sections each formed transversely outwardly of the respective side of said flat undersurface and having a concave configuration for generating a reduced pressure area on opposite sides of said flat undersurface for reducing frictional losses and increasing stability, the outer periphery of said first pair of curved sections in transverse cross sections of said hull being defined by a raised chine, a second pair of curved sections formed transversely outwardly of the first pair of chines and having a concave configuration, the outer periphery of said second pair of curved sections in transverse cross sections of said hull being defined by a second pair of chines, and a third pair of curved sections curving convexly from said second pair of chines and extending transversely outwardly of second pair of chines, the outer periphery of said third pair of curved sections being defined by a third pair of chines in transverse cross sections of said hull.

2. A watercraft hull as set forth in claim 1 wherein the chines extend generally parallel to the longitudinal center line from the rear of the watercraft hull to forwardly of its center of gravity and thereafter curve inwardly toward the longitudinal center line.

3. A watercraft hull as set forth in claim 1 wherein the third pair of chines is formed upwardly and outwardly of the first, second and third curved sections.

4. A watercraft hull as set forth in claim 3 wherein the flat undersurface comprises no more than one-third of the width of the hull.

5. A watercraft full as set forth in claim 4 wherein the third pair of chines are defined by generally horizontally downwardly facing surfaces.

6. A watercraft hull as set forth in claim 1 wherein the third pair of chines comprising generally horizontally extending undersurfaces formed at the outer peripheral edges of the third curved sections for engaging the water upon leaning of the watercraft for assisting its stability and for limiting the amount of leaning permitted.

* * * * *